US006450926B1

(12) United States Patent
McKernan

(10) Patent No.: US 6,450,926 B1
(45) Date of Patent: Sep. 17, 2002

(54) EXERCISE DEVICE

(76) Inventor: Thomas Andrew McKernan, 35 McDonald Way, Churchill VIC (AU), 3842

( * ) Notice: Subject to any disclaimer, the term of this patent is extended or adjusted under 35 U.S.C. 154(b) by 0 days.

(21) Appl. No.: 09/295,837

(22) Filed: Apr. 21, 1999

(30) Foreign Application Priority Data

Apr. 21, 1998 (AU) ..... PP3086
Nov. 26, 1998 (AU) ..... PP7312

(51) Int. Cl.[7] ..... A63B 21/002

(52) U.S. Cl. ..... 482/91; 482/92; 482/148; 602/19

(58) Field of Search ..... 482/91, 92, 105, 482/148; 602/6–8, 19; 128/102.1, 103.1, 115.1, 104.1, 123.1

(56) References Cited

U.S. PATENT DOCUMENTS 1,072,804 A * 9/1913 Appley ..... 128/103.1
4,275,718 A * 6/1981 Jungmann ..... 128/103.1
4,775,148 A * 10/1988 McLaughlin ..... 482/105
5,401,228 A * 3/1995 McLaughlin ..... 482/105
5,433,697 A 7/1995 Cox
5,830,167 A * 11/1998 Jung ..... 602/19

* cited by examiner

*Primary Examiner*—John Mulcahy
(74) *Attorney, Agent, or Firm*—McGarry Bair LLP

(57) ABSTRACT

An exercise device comprises a rear support which is contoured to be placed against the small of the back, a rigid front pate having a front pad forming a load or resistance to movement against the front plate and an adjustable linkage interconnecting the front plate and the rear support for adjusting the size of the exercise device and the load or resistance, so that repeated use of the exercise device results in improvement of the muscle tone of a person using the device, thereby improving the condition of the muscles in the abdominal region of the user.

16 Claims, 2 Drawing Sheets

EXERCISE DEVICE

CROSS-REFERENCE TO RELATED APPLICATION

This application claims the benefit of Australian Patent Application No. PP3086, filed Apr. 21, 1998 and Australian Patent Application No. PP7312, filed Nov. 26, 1998.

BACKGROUND OF THE INVENTION

1. Field of the Invention

The present invention generally relates to a medical or related device and in particular to an exercise device for improving the health and well-being of a person. More particularly, the present invention relates to an exercise device for toning or strengthening the abdominal muscles or the abdominal region of a person using the device. Even more particularly, the present invention relates to an exercise device which supports the back of a wearer or user of the device whilst presenting a load or resistance against which the abdominal muscles are exercised in order to tone or strengthen the abdominal muscles. It is thought that the effect of toning or strengthening the abdominal muscles in that the pelvic contours are realigned. The present invention finds particular application as a portable or transportable exerciser for improving the health or well-being of a person by permitting the abdomninal area of the person to be improved by exercise, which exercise can be performed even when the person is in a sedentary position or engaged in a sedentary activity, such as sitting or driving a motor vehicle.

2. Related Art

Although the present invention will be described with particular reference to one form of the exerciser, it is to be noted that the scope of the present invention is not limited to the described embodiment, but rather the scope of the present invention is more extensive so as to include other arrangements and embodiments of the device, its use for other purposes than described, and its use in other applications.

As society becomes increasing sedentary, there is less opportunity and time available for exercising, particularly exercising whilst performing other tasks such as sitting at work, in an office, driving a motor vehicle or the like. In a sitting position it is not usually possible for a person to improve the tone or strength of their abdominal region through exercise since existing exercise machines usually have moving parts that must be moved in order to exercise the abdominal or other muscles. The lack of opportunity and availability to exercise results in a deterioration of the tone and strength of the abdominal muscles and surrounding regions of the body. Increasingly, industrialized societies such as those of the western world have a high incidence of people with weak or atrophied abdominal muscles or abdominal regions caused by excessive sitting and/or lack of exercise, particularly exercise of the muscles located in or about abdominal region. It is not always convenient to exercise at work, home or whilst driving, and with more stressful modem lifestyles there is often little or no time available for exercising, particularly exercising the abdominal muscles, involving the use of conventional exercise machines. Therefor, there is a need to be able to exercise the abdominal region whilst engaged in other pursuits.

The deterioration of muscle condition in the abdominal region results in some physical malfunctions, such as for example back pain, hernias, and digestive inefficiencies and disorders. Additionally the lack of support from these muscles may cause the pelvis to misalign. Although poor muscle tone in the abdominal region is not the sole cause of many malfunctions or disorders, it is a contributing factor. Therefore, if it were possible to increase the strength and tone of the abdominal region, improved health and well-being should result and many malfunctions and disorders could be ameliorated, if not eliminated or prevented entirely.

Another health problem afflicting an increasing number of the population is back pain. It is thought that at least some of the causes of back pain result from poor abdominal muscle tone or low abdominal muscle strength. It is also thought that pelvic misalignment causes some, if not all, of the unexplainable lower back pain for which medical practitioners and other health workers cannot identify a cause. It is also believed that pelvic misalignment is the cause of sciatica and related conditions. Therefore, if the condition of the abdominal region of a person suffering from back pain is improved, there should be a corresponding improvement in the back pain. Accordingly, there is a need to provide an increased opportunity and availability to improve the strength and tone of abdominal muscles and the abdominal region by exercise in order to alleviate back complaints.

One problem of existing exercise devices for toning the abdominal region is that such devices are usually large and bulky and require the use of moving parts, some of which are heavy, in order to exercise, which in turn requires space for the exercise machine to be stored and/or located, including in some embodiments having to be firmly fixed to the floor or similar. Owing to their nature, size and use, such exercise machines cannot be used to exercise the abdominal region whilst the person using them is performing other tasks. Normally, such previously available devices have required the person using the exercise device to adopt a number of different positions or postures, including moving through the variety of positions during the performance of the exercise regime. Therefore, there is a need for an exercise device that can be used to tone or condition the abdominal region of a person whilst that person is engaged in another activity such as sitting at a desk, working in an office, driving a vehicle, or similar, and which is compact, lightweight and portable.

Previous attempts at reducing back pain have involved the use of external back and stomach supports primarily to provide support for persons at risk of pain when engaged in active sports or recreational pursuits. One such combined support is made of two flexible pads interconnected together by one or more flexible straps in which one of the pads is a back pad contoured to the shape and curvature of the small of the back of the person wearing the support in order to provide support for the back, whilst the other pad is an abdominal support pad for supporting the abdominal region of the person wearing the support. The primary object of using such supports is merely to provide support for the body of the wearer and not to increase the strength of the relevant parts of the body through exercise or by following a specific and/or rigorous exercise regime. The front and rear pads of such supports are essentially flexible allowing the pads to conform to the body as it moves and to continue to provide support for the body as it undergoes changes during the movement, such as for example when playing sport or engaged in recreational pursuits. As the support is essentially flexible, it does not provide a load or resistance against which it is possible to exercise, as is required of the exercise device of the present invention.

SUMMARY OF THE INVENTION

Accordingly, it is one aim of the present invention to provide an exercise device which allows the tone or strength of the abdominal muscles or abdominal region of a person to be improved, thereby improving the health and well-being of a person suffering from any one of a number of complaints attributable to weak abdominal muscles, such as for example back pain, hernias, digestive inefficiencies, or the like.

It is another aim of the present invention to provide a portable or transportable exercise device that may be used to improve the condition of the abdominal region of a person using the device whilst the person is engaged in other activities, particularly whilst the person remains seated.

It is another aim of the present invention to provide an exerciser having a rigid front portion which can be used as a load or resistance against which it is possible to exercise the muscles in the abdominal region in order to increase the muscle tone and to build the abdominal muscle tissue of a person.

According to one aspect of the present invention there is provided an exercise device, particularly adapted to improve the condition of the abdominal region including the abdominal muscles of a person, comprising a rear member for contacting a portion of the back of a person in order to provide support for the back in use of the device, a substantially rigid front member for contacting a portion of the abdominal region of a person during use of the device to present a load or resistance against which the abdominal region can be exercised, and a jointed and rigid adjustment means interconnecting the back and front members in order to adjust the magnitude of the load or resistance applied to the abdominal region, whereby the condition of the abdominal region of a person using the exercise device can be improved by tensing of the abdominal region against the load.

According to another aspect of the present invention there is provided a method of exercising the abdominal region of a person, including the abdominal muscles, comprising attaching an exercise device to the person, said exercise device comprising a rear member for contacting a portion of the back of the person to provide support for the back, a substantially rigid front member for contacting a portion of the abdominal region to present a load or resistance, and an adjustment means interconnecting the front and rear members for adjusting the load presented by the device, adjusting the load presented by the device, and pushing, flexing or otherwise moving the muscles of the abdominal region against the front member, thereby exercising the abdominal muscles to improve the condition of the abdominal region.

Typically, the rear member of the device of the present invention is a back support, preferably a solid back support for providing support for the back in use of the device for exercising the abdominal region. Typically, the rear member is adapted to contact the small of the back of the wearer. More typically, the rear member is a rigid plate or similar covered with a contoured resilient material. Even more typically, the contour comprises a curve from upper to lower and from side to side. More typically, the rear member is a rigid single unit incorporating the rigid plate.

Typically, the back plate is a personally molded, tailor made bespoke unit in that the back plate is molded or otherwise made from thermoplastic material which can be shaped to the actual contour of an individual patient's back so that it can adopt the exact shape of the individual patient's upper pelvis. More typically, the back place is remolded as a result of improvements in muscle tone due to the exercise program. Even more typically, the back plate is repeatedly remolded as the pelvic area realigns.

More typically, the rear member provides the foundation for the load or resistance offered by the device during use. Even more typically, the rear member can be used to exercise the back muscles in order to improve their tone or condition. More typically, the rear member is provided with connection means, coupling means, fastening means or the like for interconnecting the front member thereto. Even more typically, the connection means is adjustable so as to adjust the size of the exerciser to the person. More typically, the adjustment means adds to the rigidity of the back member.

Typically, the front member for contacting the fleshy abdominal region of a person is contoured to conform generally to the shape of the abdominal region. Typically, the front member comprises a pad or similar provided with a pair of spaced apart curved arms extending outwardly from the pad towards the wearer in use of the device. More typically, the outwardly extending arms are curved inwardly to conform to the contours of a person and/or to partially envelop the abdominal region of the person. Typically, the front member is provided with coupling means, contractor means or fastening means to assist in interconnecting the front and rear members.

Typically, the adjustment means interconnecting the rear member and front member is provided with an adjustment to vary the size of the device by varying the distance between the front and rear member in order to accommodate different sized people. More typically, there are one, two, three, four or more individual adjustment means which contribute to adjusting the size of the device. Even more typically, the adjustment means are infinitely variable between limits. Alternatively, the adjustment means are stepwisely adjustable between limits. Typically, adjustment of the adjustment means adjusts the load presented by the device. More typically, the adjustment means alters the tension or effort that has to be exerted by the muscles when exercising to tone the muscles. Even more typically, the adjustment means is used to adjust the front plate with respect to the abdominal muscles so as to determine the length of extension of the abdominal muscles when exercising and the amount of effort required.

Typically, the exercise device can be used to condition the abdominal region of a person by moving the muscles in that region against the device whilst that person is engaged in another activity, such as for example an activity involving sitting down. More typically, the person wears the exercise device whilst sitting or driving or the like.

Typically, the exercise device operates on the principle of supporting the lower back in direct proportion to the pressure being exerted by the abdominal muscles. This allows the user to exercise abdominal muscles to their maximum power, without aggravating the existing damage to the lower back and/or pelvic areas.

It is thought that such damaged or misaligned regions can be given an appropriate and natural support to rebuild the abdominal muscles, which ultimately results in the user's health returning.

Typically, one of the benefits of the exerciser of the present invention and the exercise regime undertaken when using the exerciser is to produce strong and effective abdominal muscles, by the effective, strenuous exercising of abdominal muscles independently of other body regions, except for the user's lower back which is of necessity enveloped by the back plate.

It is to be noted that the back plate of the exercise device serves dual functions, being to rigidly contain the lower back region skeletal frame, and to be an immovable foundation to which the front plate of the exerciser is anchored.

Typically, the exercise device of the present invention is worn such that the interconnection means or adjustment means is arranged to be clear of the hip bones and pelvic bones of the user. Additionally, the exerciser is so shaped and arranged that the front plate or pad does not contact the hip or pelvic bones but rather the front member contacts the fleshy part of the abdominal region.

More typically, the exercise device of the present invention is unique in that its rigidity and clearance from the hip and pelvic bones offers the user the opportunity of exerting maximum abdominal muscle tension without causing pressure pain to the hip and pelvic bones or the tissue covering these bones.

Typically, in use of the exerciser of the present invention, the abdominal region is rejuvenated by being exercised independently of other muscles.

Typically, use of the exercise device of the present invention realigns the pelvis and/or pelvic contours of the person using the device. It is thought that when a patient's pelvic frame realigns, there is a reduction in the pain experienced by the patient. Continued use of the device of the present invention may well result in complete pain relief or at least a substantial reduction in the amount of pain experienced by the patient.

More typically, the exercise program involving the use of the exerciser of the present invention is as follows:

1) Clip the device around the abdominal region of the body and tighten the interconnecting means until the device feels firm but not tight.

2) Repeatedly tense and relax the stomach muscles in turn over the period of exercise.

3) Remold the back plate after a period of time of exercising (such as for example after some weeks) and continue exercising, repeating the previous steps.

Typically, the pelvic bones are realigned as a result of the continued exercising, which necessitates a remolding of the back plate.

DETAILED DESCRIPTION

Figure 1:
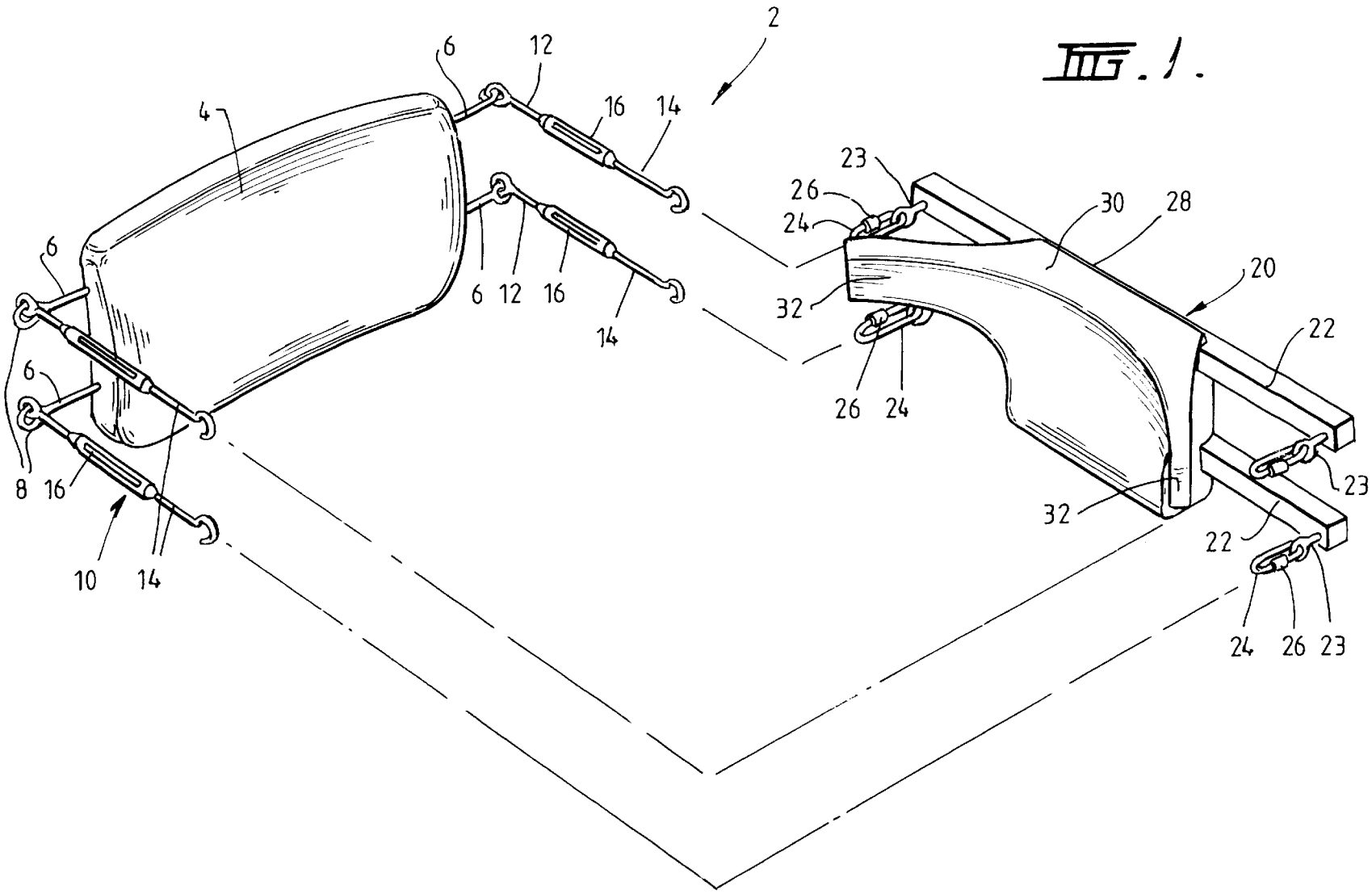
FIG. 1 is a perspective view of one form of each of the rear and front members of the device of the present invention shown separated from each other.
Figure 3:
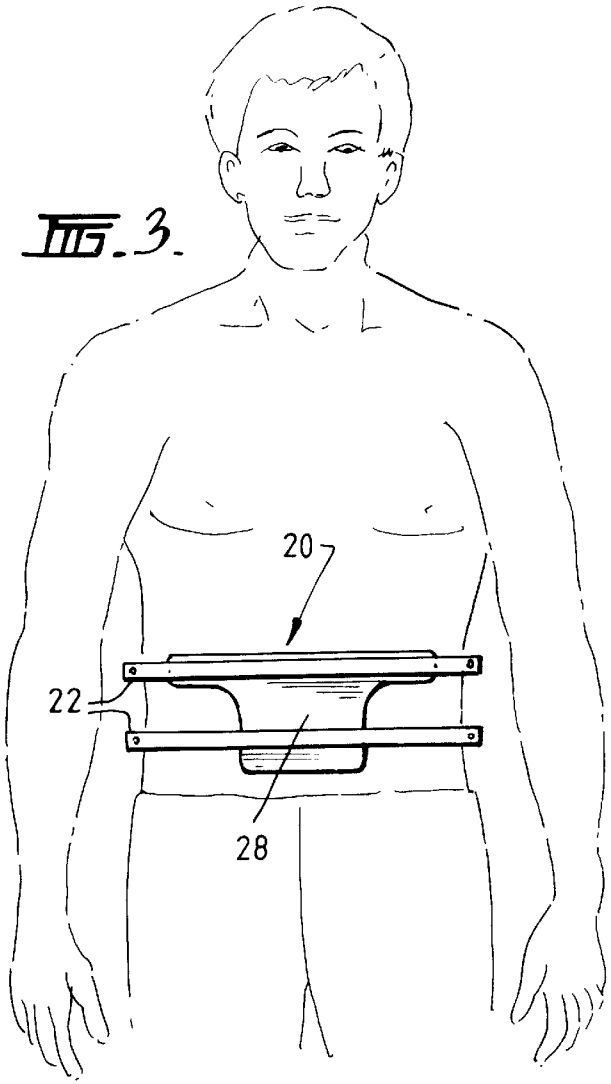
FIG. 3 is a front view of the front member of the device of the present invention shown in site when worn by a person.
Figure 2:
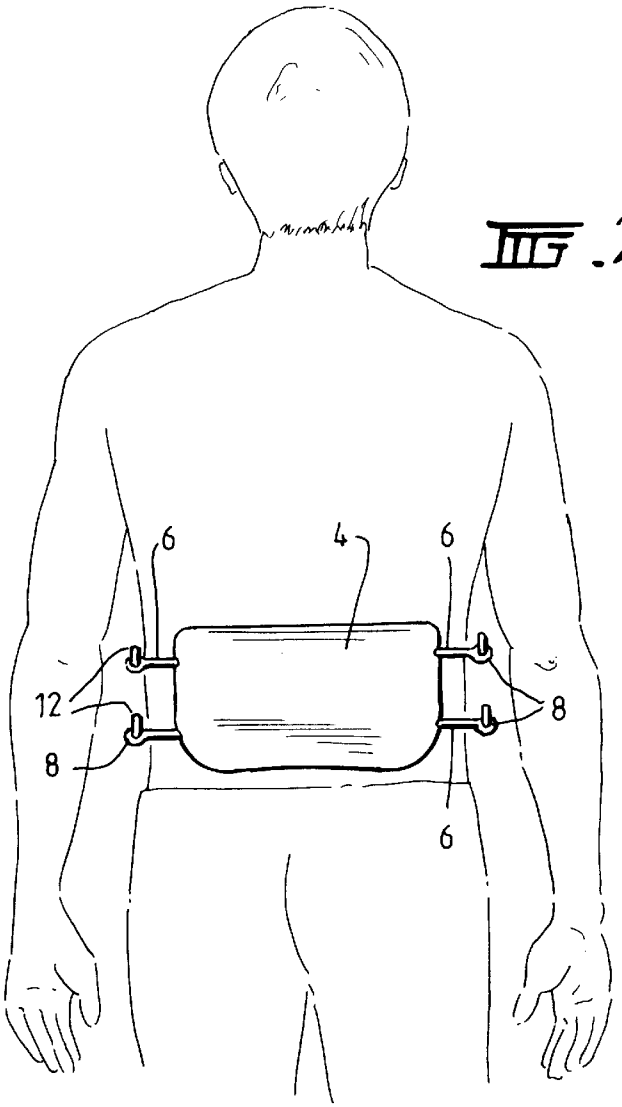
FIG. 2 is a rear view of the rear member of the device of the present invention shown in site when worn by a person.

In FIG. 1 there is shown an exploded view of one form of the main components of the exercise device of the present invention, which device is generally denoted as 2. The device 2 comprises a rear support pad 4 or similar made from a rigid material providing a back support. The support pad 4 may be made from any suitable material, such as for example an internally located rigid metal plate or similar frame member covered with an outer covering of resilient padding material such as a synthetic foam material. Examples of synthetic foam materials include polyurethane foam, polyether foam or similar synthetic foam material or the like. It is to be noted that the rear member may be partially or entirely covered with the resilient material. Preferably, the front facing or forwardly directed surface of the pad is covered with resilient synthetic material. Pad 4 supports the back during use of the device and produces or at least contributes to the load or resistance of the exercise by being rigid.

Although the interally located rigid metal plate or framework member may be flat and/or straight, the outer surface or covering of the pad is contoured to be positioned in the small of the back of the user of the exerciser. Accordingly, the pad 4 is contoured from top to bottom in a convex shape in accordance with the general shape of curvature of this part of the back, and is contoured from side to side in a concave curve also generally in accordance with the curvature of this part of the back. A pair of pins or lugs 6 or similar are provided on either lateral side of the support member extending, outwardly in spaced apart relationship to each other. Each pin or lug 6 is provided with a looped head or ring 8 at their respective distal ends. In one embodiment, the pins are ring bolts or similar screw-threadingly received in threaded bores in the metal plate or frame of pad 4. It is to be noted that although four ring bolts are shown extending laterally from both sides of the support pad 4, any number of ring bolts can be used. It is to be noted that any form of coupling or fastener can be used in place of the ring bolts for connecting the rear pad 4 to the front member.

Suitable adjustment means are connected to the heads 8 of ring bolts 6. One form of the adjustment means is an adjustable turnbuckle 10 having a threaded ring bolt 12 and a threaded hook 14 both received in a threaded center portion 16. Although adjustable tumbuckles 10 having heads and hooked ends are shown, any suitable adjustment means, such as webbing, springs, bolts or similar couplings or connectors may be used, provided there is sufficient clearance between the adjustment means and the hips so that the adjustment means does not contact the hips. Further, although four adjustable tumbuckles 10 are shown being connected to respective ring bolts 6, any number of tumbuckles 10 or adjustment means generally can be used. It is to be noted that the adjustment means can take any suitable or convenient form.

Turning now to the front member 20, one form of the front member 20 is provided with a pair of transversely extending bars 22 located in spaced apart, parallel relationship to each other. Each end of each bar 22 is provided with a coupling means for cooperatively engaging with the hooked end 16 of the adjustable turnbuckles 10 connected to the rear support member 4. One form of the coupling is a ring bolt 23 securely fastened to one end of transverse bar 22 to which is connected a shackle 24 having an internally threaded release sleeve 26 for selectively opening and closing the link. In use, the hook 16 located at one and of the adjustable turnbuckle 10 is received through the threaded shackle 24 so as to interconnect the front member 20 with the rear pad 4.

Front member 20 further comprises a contoured front pad 28 or similar which is fixedly connected to the spaced apart transverse bars 22. Front pad 28 comprises a main body portion 30 and a pair of sidewardly curved, inwardly extending arms 32. The front surface of the pad 28 including the arms 32 is curved generally to match the contour of the abdominal region of the person using the exercise device 2. In use, the front surface of pad 28 is designed to contact the abdominal region of the user when worn so that the pad 30 provides a resistance, load or reaction surface against which the muscles in the abdominal region may be exercised by forcing the abdominal region against the pad 30 and arms 32 by pushing, flexing or otherwise moving the abdominal muscles to place the muscles in tension. The muscles can be maintained under tension for variable periods of time to further strengthen and tone them.

The contoured front pad 28 having the arm members 32 may be made from any suitable material such as an internally located metal or wooden plate or similar, or a combination of suitable materials such as a composite or laminate. It is to be noted that the construction of the front pad is such that it is extremely rigid to provide the necessary load or resistance against which the abdominal region can be exercised. In particular, the metal plate is securely connected to the two transverse bars 22 to form a rigid unit. The outer surface of the pad may be resilient or flexible and can be molded to shape or otherwise formed as required. The pad 28 and arms 32 are covered with a suitable covering of resilient material, particularly the inner surface of the pad and arms for contacting the body in use of device 2 so that the exerciser is comfortable to use without risk of injury to the person.

In use, the device 2 of the present invention is attached to the body by the rear member 4 being located in the small of the back of the user and the front support member 20 being located at an approximate position in front of the abdominal region with the adjustment means at one side interconnecting both members. When in the approximate position, the adjustment means on the other side is put in place to interconnect the front and rear members on both sides. When the rear and front members are positioned in a comfortable position, the adjustable tensioning means are adjusted to adjust the position of the front and back members so as to maintain them in a comfortable but firm position under the desired tension. It is to be noted that a desired position is one in which device 2 feels slightly tight to the wearer, thus ensuring that the abdominal muscles have a load or resistance to work against. In this position, the abdominal muscles are flexed against the resistance or load provided by the front surface of the front support member 20, particularly the front surface of the body 28 and arm 32, to provide resistance for the muscles. The muscles can be tensioned to maintain the abdominal region in abutting relationship with device 2 to strengthen and condition the abdominal region, including the abdominal muscles. Movement of the muscles can be periodic, intermittent or continuous, depending on need.

One example of the exercise program or regime useful in realigning the pelvic area or pelvic contour of the user of the device of the present invention is to repeatedly tense the stomach muscles, particularly against the resistance provided by the front plate, and then relax the abdominal muscles. This sequence of tensing and relaxing is repeated for the duration of the exercise regime. After some weeks of exercising in this manner, it is often necessary to remold the back plate. With the newly remolded back plate in position against the small of the back, the exercise regime is repeated by alternately tensing and relaxing the muscles against the load or resistance provided by the device of the present invention. It may well be that after some more weeks of using the device of the present invention it is necessary to further remold the back plate and continue with the sequence of alternately tensing and relaxing the abdominal muscles.

Modifications of the exercise device of the present invention include the following. The rear pad 4 may be made as a single piece, such as for example by molding or similar, or may be made as two or more separate pieces which can be used in conjunction with each other, such as for example in the form of a pad of thermoplastic material which may be loosely strapped directly to the skin of a person by using elastic cords or similar, and when the person is dressed, a rigid frame, plate or similar may be fitted to or over the pad to provide the necessary rigidity, strength, reinforcement or similar.

Similarly, front pad 28 may be made as a one-piece construction or may be made from two or more pieces connectable together, such as for example in a manner similar to the modified rear pad. Where the pads and corresponding frames are separate components connected or connectable to each other, any suitable frame members for providing rigidity may be employed and any form of adjustment means may be used to interconnect them.

Another modification is to the front and rear pads which may be made from suitable thermoplastic material which can be molded to the actual contours of the back and abdominal regions of the person using the device. In this way, the pads can be made more comfortable to use and more effective since the abdominal muscles are in direct contact with the pads so that immediately upon flexing the muscles encounter a load or resistance and accordingly there is no wasted effort. Once cold, the thermoplastic pads have their original rigidity so can present the same load. If additional rigidity is required, a brace, frame, plate, or similar reinforcing member may be added to the thermoplastic pads on its outer surface in use.

Another modification of the device of the present invention relates to having bespoke front and rear pads made from thermoplastics material molded to the exact shape of an individual's body. The pads are located in contact with the relevant part of the body and attached to each other by connection means, such as adjustable straps, belts, or similar or the interconnection means as described previously or combinations thereof, all of which can be used to adjust the tension applied to the pads and thus the load or resistance offered by the exerciser.

In another embodiment, an outer frame is provided incorporating both front and rear members and the interconnection means. In this embodiment, the frame incorporating the interconnection means at the side is hinged or otherwise jointed at the side of the front and/or rear pads in order to allow adjustment of the tension applied to the muscles and to vary the size of the exerciser. A further modification is to provide a cover for the frame and plates whilst still achieving the required clearances away from the hips.

In another embodiment, the pads are interconnected to each other by adjustable springs either alone or in combination with other components. The adjustable springs are provided to apply a preselected tension to the pads. The springs may be connected to the front pad, the rear pad or the rods, belts, straps, cords or similar, or any combination thereof located on the sides of the exerciser.

Another modification of the exercise device of the present invention includes providing a heating element or similar within or connected to the rear support or back plate. In this modification, a heating element, such as for example an electrically operated heating element, is embedded within or located adjacent the material from which the remoldable back plate is made in order to heat and/or soften the back plate, so that it can be remolded to the changing shape of the back of the person using the exerciser. In this manner, the back plate is shaped to the contour of the back to support the user's skeletal frame as it progresses through the realignment phases.

In a further modification, the heating element is powered by connecting it to the power supply of a motor vehicle, such as for example the power outlet or cigarette lighter socket located in the dashboard or similar region of the vehicle. By using this modification, it is possible to reshape the back plate of the exerciser whilst using the device when travelling in the motor vehicle.

These and other modifications can be made to the device of the present invention.

At first, the adjustment means are adjusted to provide a relatively weak or low load or resistance. After repeated use, when the condition of the abdominal muscles improves, additional tension can be applied by the adjustment means to provide a greater resistance or load for further strengthening or conditioning the abdominal muscles.

After repeated and prolonged use of the device of the present invention, the abdominal muscles can be conditioned to such an extent that back pain or other malfunctions or disorders are eliminated or at least minimized or ameliorated, particularly back pain caused by pelvic misalignment, since the device of the present invention is useful in realigning the pelvic region.

It is to be noted that because the device of the present invention is compact, lightweight and portable, it can be worn and used by the user at any convenient time to exercise the abdominal region. Even when sitting down working at a desk or driving a motor vehicle, the device 2 may be attached around the body and tensioned to a desired tension so that the muscles can be successively tensioned and relaxed to exercise the muscles. As the device does not contain any components which move during use, but rather relies on fixed components offering resistance or load, the device can be used whilst sitting. Thus, use of the device is more flexible and convenient than conventional exercise machines, so that even a person who has little or no time for regular exercise with conventional exercise machines can use the device of the present invention to tone, strengthen and maintain the abdominal region whilst engaged in other activities.

Advantages of the present invention include the following: The device is compact and portable and readily trarsportable so that it may be used at home, in the office, or when driving a car or other vehicle. The adjustment allows the load to be varied in accordance with the condition and tone of tie muscles in the abdominal region, and the amount of exercise required. As the back pad and/or front pad are each made of thermoplastic material, they may be repeatedly remolded individually to the changing contour of the back of the patient and re-used.

The described arrangement has been advanced by explanation and many modifications may be made without departing from the spirit and scope of the invention which includes every novel feature and novel combination of features herein disclosed.

Those skilled in the art will appreciate that the invention described herein is susceptible to variations and modifications other than those specifically described. It is understood that the invention includes all such variations and modifications which fall within the spirit and scope.

What is claimed is:

1. An exercise device for improving the condition and/or tone of the abdominal region of a person, particularly the rejuvenation and/or strengthening of a person's abdominal muscles, comprising a rigid rear member for contacting a portion of the back of the person in order to provide support for the back in use of the device and/or to anchor the device during use, a substantially rigid front member for contacting a portion of the abdominal region of the person during use of the device to present a load or resistance against which the abdominal region can be exercised by movement of the abdominal muscles, and an adjustment means interconnecting the back and front rigid members in order to adjust the magnitude of the load or resistance applied to the abdominal region by movement of the abdominal muscles against the rigid front member, said adjustment means being jointed and rigid, wherein when the abdominal region of the person is exercised against the load or resistance by movement of the abdominal muscles, the condition of the abdominal region of the person is improved.

2. An exercise device according to claim 1 in which the rear member is a solid back support adapted to contact the small of the back of the user of the device.

3. An exercise device according to claim 1 in which the rear member is a rigid plate or frame member covered with a resilient material contoured to the back of the wearer.

4. An exercise device according to claim 3 in which the resilient material is a synthetic foam material including one of polyurethane foam and polyether foam.

5. An exercise device according to claim 1 in which movement of the adjusting means adjusts the load or resistance to movement or exercising presented by the rigid front member.

6. An exercise device according to claim 1 in which movement of the adjustment means both alters the size of the exerciser for enveloping the waist region of the person using the device and adjusts the load or resistance offered by the front member of the exerciser to movement by the abdominal muscles of the person using the device.

7. An exercise device according to claim 1 in which part of the abdominal region of the person is fleshy and the rigid front member is contoured to conform generally to the shape of the fleshy portion of the abdominal region to assist in presenting a load or resistance to the movement of the abdominal muscles of the person using the device.

8. An exercise device according to claim 1 in which the front member comprises a pad provided with a pair of spaced apart curved arms extending outwardly from the pad in a direction towards and around the body of the person using the device.

9. An exercise device according to claim 1 which the adjustment means has at least one adjustable connector interconnecting the front and rear members.

10. An exercise device according to claim 9 in which the adjustable connector has tworigid but jointed parts, allowing movement of one part with respect to another part.

11. An exercise device according to claim 10 in which the adjustable connector includes adjustable trunbuckles threadingly engaged with ring bolts.

12. An exercise device according to claim 1 in which the adjustment means includes a pair of pins or lugs extending laterally from either side of the rear member in spaced apart relationship to each other.

13. An exercise device according to claim 12 in which the pins or lugs are provided with loops or rings at their respective distal ends.

14. An exercise device according to claim 1 in which the rear member is a personally molded, tailor-made unit being made from or having a covering made from a thermoplastic material allowing repeated remolding of the shape of the back member to accommodate changes in the body occasioned by repeated use of the exercise device.

15. An exercise device according to claim 1 in which the front member further includes a pair of transversely extending bars located in spaced apart, parallel relationship to each other.

16. An exercise device according to claim 15 in which the two transversely extending bars are connected to a metal plate or frame member to provide increased rigidity for the front member.

* * * * *